United States Patent [19]

Bielecki et al.

[11] Patent Number: 5,018,944

[45] Date of Patent: May 28, 1991

[54] CEILING FAN CLEANER APPARATUS

[76] Inventors: John R. Bielecki, 3604 Spanish Ct., Hephzibah, Ga. 30815; Thomas J. France, 1188 Norman St., North Augusta, S.C. 29841

[21] Appl. No.: 456,333

[22] Filed: Dec. 26, 1989

[51] Int. Cl.[5] ..... F04D 29/70

[52] U.S. Cl. ..... 416/146 R; 416/62; 15/256.5

[58] Field of Search ..... 416/5, 62, 146 R, 170 R; 15/256.5

[56] References Cited

U.S. PATENT DOCUMENTS

| | | | |
|---|---|---|---|
| 3,355,177 | 11/1967 | King | 15/256.5 X |
| 4,676,721 | 6/1987 | Hardee | 416/146 R |
| 4,750,863 | 6/1988 | Scoggins | 416/146 R |
| 4,832,572 | 5/1989 | Prucha et al. | 416/146 R |

FOREIGN PATENT DOCUMENTS

| | | | |
|---|---|---|---|
| 865220 | 2/1953 | Fed. Rep. of Germany | 15/256.5 |

*Primary Examiner*—John T. Kwon
*Assistant Examiner*—James A. Larson
*Attorney, Agent, or Firm*—Michael A. Mann

[57] ABSTRACT

An improved ceiling fan comprises a holder carrying a multiplicity of thin fibers, the holder cantilevered over the blades and lightly dragging the fibers over the rotating blades so that dust and dirt are brushed from the surface of the blade before they adhere. For existing ceiling fans the holder is attached to the housing of the fan by a collar. The holder fastens to the collar so that it may be turned from a "summer" position to a "winter" position to drag the fibers across the surface of the blades regardless of the direction of rotation. The fibers are preferably of a low conductivity, low hydroscopic material such as NYLON.

20 Claims, 2 Drawing Sheets

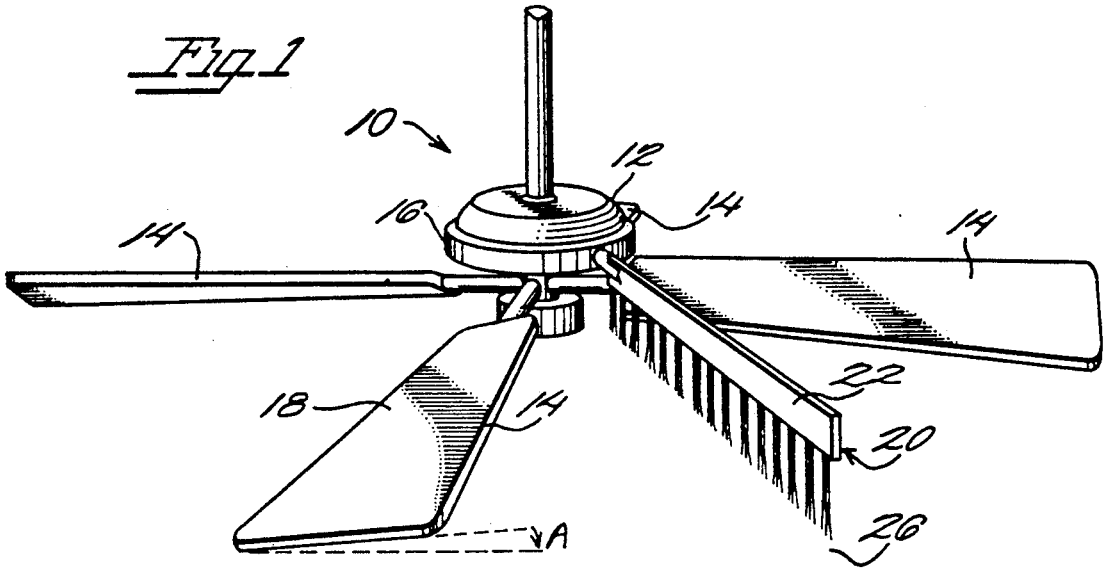
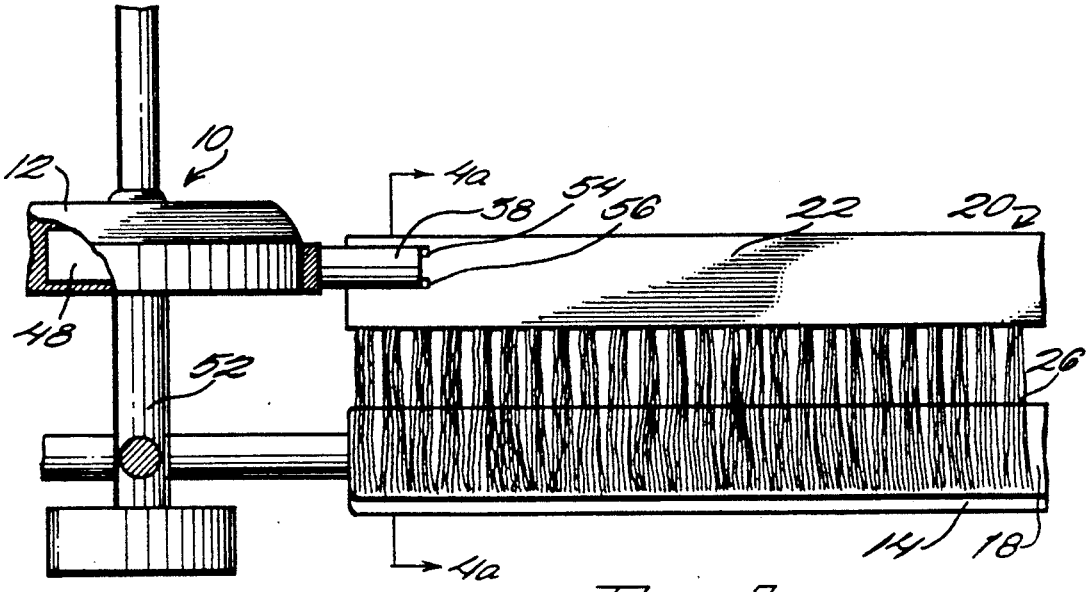
Fig. 3

CEILING FAN CLEANER APPARATUS

BACKGROUND OF THE INVENTION

1. Field of the Invention

The present invention relates to ceiling fans. More particularly, the present invention relates to apparatus for keeping ceiling fan blades clean.

2. Discussion of Background

Ceiling fans have long been used to make rooms of homes in warm climates more comfortable. In recent times, ceiling fans have enjoyed great popularity as a design feature of new homes in all climates and, more importantly, as an energy saving feature since a circulating ceiling fan can make rooms more comfortable year round with less reliance on air conditioning and heating. Office buildings and restaurants are often equipped with ceiling fans for energy efficiency.

However, the circulating blades inevitably become dirty and greasy, especially in a kitchen or restaurant. Cleaning the blades requires their removal and washing or washing in place, which can be a time-consuming or inconvenient chore especially if the fan is located in a room with a high ceiling or a room in constant use. Several attempts have been made to eliminate the problem of cleaning the blades. See for example, Hardee's patent, U.S. Pat. No. 4,676,721, and Prucha, et al's patent, U.S. Pat. No. 4,832,572, both for blade coverings. Neither of these devices eliminates all of the problems associated with the chore of cleaning the blades. For example, in the past, cleaning the surfaces of the fan blades required an individual to climb and stand on a step ladder or stool during the entire process. As a result, cleaning was not only a difficult task, but also a dangerous one. Furthermore, both of these devices introduce coverings for fan blades that may detract from the aesthetic appearance of the blades themselves.

There is a need for a method and apparatus for cleaning fan blades that overcomes the problems of the prior art.

SUMMARY OF THE INVENTION

According to its major aspects, the present invention is a ceiling fan having a housing, a motor within the housing, a shaft rotated by the motor, a plurality of blades attached to the shaft, each blade having a surface, a holder carrying a multiplicity of fibers cantilevered over the blades so that the fibers drag lightly over the surfaces of the blades as the blades turn. For existing ceiling fans, the holder may be attached to the fan housing by a collar.

It is a feature of the present invention that the attaching collar is preferably adjustable so that it fits a variety of housing sizes. Most preferably, the collar grips the housing without the need for screws or other fastening devices so that installation is made easier.

It is another feature of the present invention that the dust is removed by fine fibers dragging across the surfaces of the blades rather than by brushing or rubbing. Fine fibers dragging lightly over the blade surfaces will make significantly less noise and will not retard the revolving blades.

It is still another feature of the present invention that the fibers are made of a low conductivity, low hydroscopic material so that dust and dirt do not adhere to the fibers.

It is yet another feature of the present invention that the holder is attached to the collar or, alternatively to the housing in a manner that permits turning the holder when the direction of the blades is reversed from summer to winter and also permits removal for cleaning in a conventional dishwasher.

It is still another feature of the present invention that the cleaning apparatus of the present invention substantially decreases the number of times a person resPonsible for cleaning fan blades must climb and stand on a ladder or stool and thereby increases home and workplace safety.

These and other features and advantages of the present invention will be apparent to those skilled in the art of ceiling fans from a careful reading of the following detailed description and review of the attached drawings.

BRIEF DESCRIPTION OF THE DRAWINGS

In the drawings:

FIG. 1 is a perspective view of a ceiling fan according to a preferred embodiment of the present invention;

FIG. 3 is a side view of a ceiling fan according to a preferred embodiment of the present invention;

DETAILED DESCRIPTION OF A PREFERRED EMBODIMENT

Figure 2:
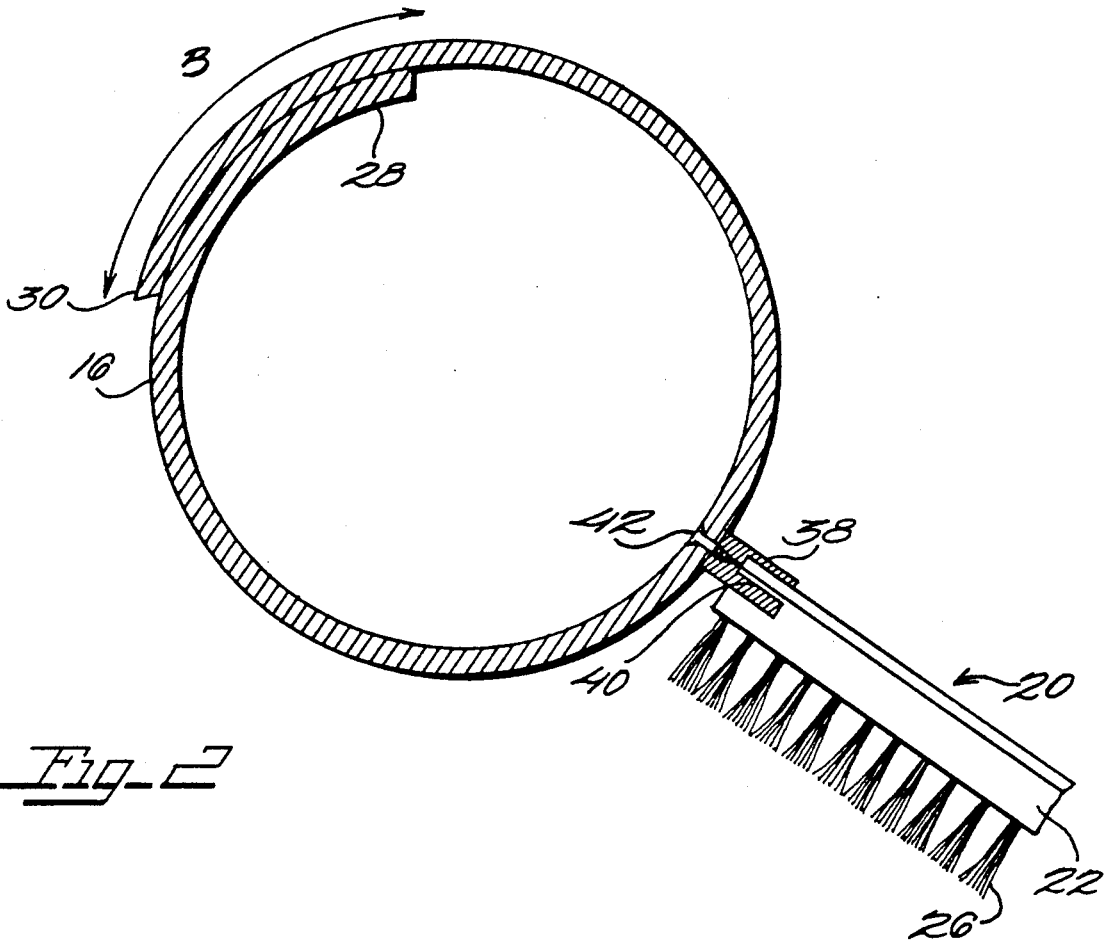
FIG. 2 is a top plan view of an attachment to a ceiling fan according to a preferred embodiment of the present invention.

The present invention is a device for cleaning the blades of a ceiling fan that may be attached to an existing ceiling fan or incorporated into the fan at the time of manufacture. Referring to FIG. 1, ceiling fan, indicated generally at 10, has a housing 12 and a plurality of fan blades 14 that may be turned clockwise or counterclockwise to draw air upward in summer or push air downward in winter. Fan blades are pitched slightly at an angle A and blades 14 rotate just below housing 12. A collar 16 is shown about housing 12 gripping housing in a manner to be described in more detail below. Cantilevered over a surface 18 of blades 14 is a brush assembly 20 having a holder 22 having a plurality of clusters of fibers 26 of a length sufficient to drag over surface 18 of blades 14. Fibers 26 are thin and not rigid, as bristles are, but are simply drawn over surface 18 as blades 14 turn below housing 12 and holder 22.

In FIG. 2 is shown collar 16 in cross section. Preferably collar 16 is made of a strip of resilient material permanently bent into a circle with a first end 28 and a second end 30 overlapped a distance B. The resilience of the material of collar 16 and the degree of overlap allow collar 16 to fit easily by compression over most housings, gripping with sufficient firmness and without using tools for installation.

Holder 22 is attached to collar 16 by a fitting 38 having a slot 40. Fitting 38 is attached to collar 16 by a screw 42, preferably a flat head screw counter sunk so that it does not scratch housing 12. Fitting 38 with holder 22 are attached to collar 16, or alternatively directly to housing 12 and eliminating collar 16, so that they can be turned for winter or summer use as will be described more fully below. By turning fitting 38 and holder 22, fibers 26 and blades 14 meet an acute angle so that noise is reduced.

Figure 4A:
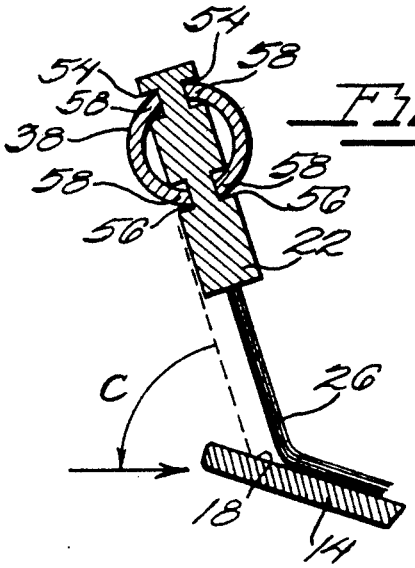
FIG. 4*a* is across sectional view of FIG. 3 along lines 4*a*—4*a* with holder turned to a first position for winter use of a ceiling fan.

In FIG. 3 is shown brush assembly 20 attached directly to housing 12 of ceiling fan 10. Inside housing 12 is a motor 48 that turns a shaft 52. Blades 14 are attached to shaft 52 and rotate therewith clockwise or counter clockwise depending on the desired direction of airflow. Fitting 38 is attached directly to housing 12. Holder 22 extends, cantilevered, over turning blades 14, with fibers 26 hanging from fitting 38 and dragging over surface 18 of blades 14 as blades 14 turn. Holder 22 is attached to fitting 38 as before, with slot 40 receiving holder 22. Holder 22, as seen in FIG. 3 has two sets of shallow, "DADO" type grooves, upper grooves 54 and lower grooves 56, one groove of each set on either side of holder 22 for receiving four edges 58 of fitting 38 at slot 40 (FIG. 4*a*). FIG. 4*a* shows a cross sectional view of FIG. 3 along lines 4*a*—4*a*. Edges 58 fit into upper grooves 54 and lower grooves 56 to hold holder 22 securely but releasably.

Figure 4B:
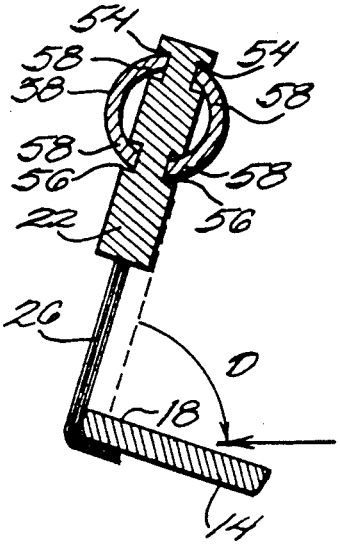
FIG. 4*b* is the same cross sectional view with holder turned to a second position for summer use of a ceiling fan.

As also shown in FIG. 4*a*, fitting 38 and holder 22 are rotated in the direction of blade 14, shown moving in a direction for winter use, so that fibers 26 meet surface 18 at an acute angle C to reduce noise. In FIG. 4*b*, when the direction of blades 14 is reversed for summer use of ceiling fan 10, holder 22 and fitting 38 are rotated to reduce the angle D at which surface 18 of blades 14 strikes fibers 26, the ends of fibers 26 then just touching surface 18 of blades 14 so that fibers 26 lightly drag across surface 18.

Collar 16 is made of any resilient material but preferably a clear or colorable, inexpensive plastic such as ABS. For most ceiling fans which are approximately 23 or 30 centimeters in diameter, a 19 centimeter diameter collar with a 6–9 centimeter overlap is sufficient to hold collar 16 to either size housing 12. Holder 22 is preferably 66 centimeters more or less long to extend beyond most size blades 14. Fibers 26 are preferably very fine, 7–13 centimeters long, made of a low hydroscopic, low conductivity material such as NYLON so that dust and dirt do not readily stick to fibers 26, and less than 0.05 centimeters in diameter, most preferably between 0.003 and 0.05 centimeters in diameter. However, it will be seen that holder 22 may be easily removed from fitting 38 for cleaning of holder 22 and fibers 26 in a dishwasher or by hand.

It will be apparent that many changes in the presently preferred embodiment may be made without departing from the spirit and scope of the present invention, which is defined by the following claims.

What is claimed is:

1. A ceiling fan comprising:

a housing;

a motor within the housing;

a shaft rotated by said motor;

plurality of fan blades attached to said shaft and rotating therewith, said blades having a surface; and means for brushing said blades as said blades rotate, said brushing means in spaced relation to said blades.

2. The ceiling fan as recited in claim 1, wherein said brush means further comprises:

a multiplicity of fibers; and means for holding said multiplicity of fibers.

3. The ceiling fan as recited in claim 2, wherein said holding means holds said fibers at an acute angle with respect to said surface of said blades so that said fibers drag lightly across said surface of said blades.

4. The ceiling fan as recited in claim 3, wherein said holding means has a first position and a second position, said first position holding said fibers so that said fibers drag across said surface of said blades when said blades are turning in a first direction and said second position holding said fibers so that said fibers drag across said surface of said blades when said blades are turning in a reverse direction.

5. The ceiling fan as recited in claim 2, wherein said fibers have an outer diameter less than 0.05 centimeters.

6. The ceiling fan as recited in claim 3, wherein said fibers have an outer diameter less than 0.05 centimeters.

7. The ceiling fan as recited in claim 4, wherein said fibers have an outer diameter less than 0.05 centimeters.

8. The ceiling fan as recited in claim 5, wherein said fibers have an outer diameter between 0.003 and 0.05 centimeters.

9. The ceiling fan as recited in claim 6, wherein said fibers have an outer diameter between 0.003 and 0.05 centimeters.

10. The ceiling fan as recited in claim 7, wherein said fibers have an outer diameter between 0.003 and 0.05 centimeters.

11. An attachment to a ceiling fan having a housing, a motor within said housing, a shaft rotated by said motor, and a plurality of blades attached to said shaft, each blade having a surface, said attachment for cleaning said blades and comprising:

a multiplicity of fibers; and means for holding said multiplicity of fibers in spaced relation to said blades, said holding means carried by said housing.

12. The attachment as recited in claim 11, wherein said holding means holds said fibers at an angle with respect to said surface of said blades so that said fibers drag lightly across said surface of said blades.

13. The attachment as recited in claim 12, wherein said holding means has a first position and a second position, said first position holding said fibers so that said fibers drag lightly across said surface of said blades when said blades are turning in a first direction and said second position holding said fibers so that said fibers drag lightly across said surface of said blades when said blades are turning in a reverse direction.

14. The attachment as recited in claim 11, wherein said holding means further comprises a means for gripping said housing so that said holding means is held in spaced relation to said blades.

15. The attachment as recited in claim 14, wherein said gripping means further comprises a collar about said housing.

16. The attachment as recited in claim 15, wherein said collar is made by a process comprising the steps of:

providing a strip of resilient material;

forming permanently said strip into a circle having overlapping ends and a diameter smaller than the diameter of said housing so that said strip will grip said housing.

17. The ceiling fan as recited in claim 11, wherein said fibers have an outer diameter less than 0.05 centimeters.

18. The ceiling fan as recited in claim 12, wherein said fibers have an outer diameter less than 0.05 centimeters.

19. The ceiling fan as recited in claim 13, wherein said fibers have an outer diameter less than 0.05 centimeters.

20. The ceiling fan as recited in claim 14, wherein said fibers have an outer diameter less than 0.05 centimeters.

* * * * *